US006503055B1

(12) United States Patent
Gerenski et al.

(10) Patent No.: US 6,503,055 B1
(45) Date of Patent: Jan. 7, 2003

(54) ENVIRONMENTAL CONTROL SYSTEM BLOWER ASSEMBLY

(75) Inventors: Robert Gerenski, Holley; Carl E. Jensen, Rochester; David J. Laluk, Fairport, all of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/699,581

(22) Filed: Oct. 30, 2000

(51) Int. Cl.[7] ..... F04D 29/44

(52) U.S. Cl. ..... 415/208.1; 415/211.1; 415/213.1; 415/214.1; 415/206; 399/92; 399/93

(58) Field of Search ..... 415/208, 1, 211.1, 415/213.1, 214.1, 203, 204, 206; 399/92, 93

(56) References Cited

U.S. PATENT DOCUMENTS 2,784,661 A * 3/1957 Jenn ..... 415/211.1
3,319,546 A * 5/1967 Magnusson ..... 399/92
4,530,589 A * 7/1985 Adams ..... 399/92
5,086,209 A * 2/1992 Kintz et al. ..... 399/92
5,192,973 A * 3/1993 Hickisch ..... 399/93
5,409,352 A * 4/1995 Lin ..... 415/213.1
5,522,700 A * 6/1996 Hong ..... 415/177
5,967,747 A * 10/1999 Burke et al. ..... 415/206

* cited by examiner

*Primary Examiner*—Christopher Verdier

(57) ABSTRACT

A blower assembly for an environmental control system comprising a blower housing and a blower operably carried in that housing, the housing having a one-piece inlet ring and ring support, the support having a plurality of upstanding columns that define the space within which the blower operates, and the housing being characterized by the absence of apertured side members. A unitary inlet ring and ring support for a blower assembly, the support having a plurality of upstanding columns, some columns having upstanding webs extending between them and between the inlet ring.

13 Claims, 6 Drawing Sheets

ENVIRONMENTAL CONTROL SYSTEM BLOWER ASSEMBLY

FIELD OF THE INVENTION

This invention relates to a blower assembly for use in an environmental control system such as that employed in a copier/duplicator machine.

BACKGROUND OF THE INVENTION

In complex apparatus such as high volume copier/duplicator machines, the atmosphere inside that apparatus is cleaned using an environmental control system that provides controlled volumes of cleaned, cooled air or other gas to various components within the apparatus, e.g., the marking engine of a copier/duplicator machine.

Environmental control systems normally contain a blower system that helps the environmental control system provide the cleaned, cool air or other gas for use in the apparatus.

For sake of brevity, further description herein will be directed toward a copier/duplicator machine and air blowing, but it is to be understood that this invention is useful in other apparatus as well and with gases other than air. Accordingly, this invention is not limited to copier/duplicator machines or air blowing.

An environmental control system is a precise and costly subsystem within a copier/duplicator machine. It is important that the efficiency of the environmental control system be maintained, if not improved, while ongoing improvement and cost reduction measures are implemented.

In copier/duplicator machines, the environmental control system employs one or more air filter chambers which chambers include one or more blower systems. The blower system employed increases the air pressure in the chamber (s) so that air can be forced through filters for particulate removal. The filtered air is then forced by the blower system out of the machine or to other parts of the machine for reuse within the machine, or both.

The mounting of the blower itself within the blower assembly of the environmental control system is particularly important. The blower assembly employs an inlet ring by which air is pulled into the blower and then forced by the blower in the direction(s) desired within the environmental control system. For efficiency's sake, the blower should maintain a very close operating relation with respect to the inlet ring. The gap between the downstream inlet edge of the inlet ring and the blower itself should be above 0.060 inch with a gap tolerance of no more than about 0.020-inch. If the gap is too small, the blower may physically impinge on the inlet ring during operation. If the gap it too large, air turbulence will result. Either one of these affects the operating efficiency and operating life of the machine.

Heretofore, as will be explained in detail hereinafter, blower assemblies have been made up of a plurality of disparate parts. The assembly of these parts was time consuming and expensive. For example, the copier/duplicator machine blower assembly described hereinafter with respect to FIGS. 1 and 2 hereof, is a five-piece weldment. Although the prior art blower assemblies are quite serviceable, a simpler, more rigid and more accurate gap controlling blower assembly is desirable. This would reduce assembly time and ease serviceability by reducing the number of parts employed. It would further greatly reduce the overall cost of the blower assembly without sacrificing, and even improving, the operating efficiency of the blower assembly with improved gap control.

SUMMARY OF THE INVENTION

According to this invention, there is provided an improved blower assembly that meets the foregoing requirements. This invention also provides an improved inlet ring and inlet ring support unit that allows a blower assembly employing this unit to meet the foregoing requirements.

The blower assembly of this invention employs a one-piece, integral (not physically separable) inlet ring and inlet ring support member or surface. The inlet ring support member also has integral therewith a plurality of upstanding columns or pillars that extend in the direction of the blower and terminate in a free end. That is to say, each column extends from the downstream side of the support member and each terminates in a free end. The columns and their free ends define the space volume or zone within which the blower operates. A blower support member is fixed to the free ends of the columns and carries a lower closure member that extends between the blower support member and the inlet ring support member on the bottom side of the blower.

The foregoing blower assembly is further characterized in that, unlike the prior art, it has no apertured side members as shown in detail hereinafter with respect to the prior art.

The inlet ring/inlet ring support unit provides a unitary, integral article as opposed to the two separate pieces in the prior art that require hand assembly. This article also has, integral with the inlet ring support surface, a plurality of upstanding columns each with a free end, the columns and their free ends defining the space volume or zone in which a blower may operate.

DESCRIPTION OF THE PREFERRED EMBODIMENTS

Figure 1:
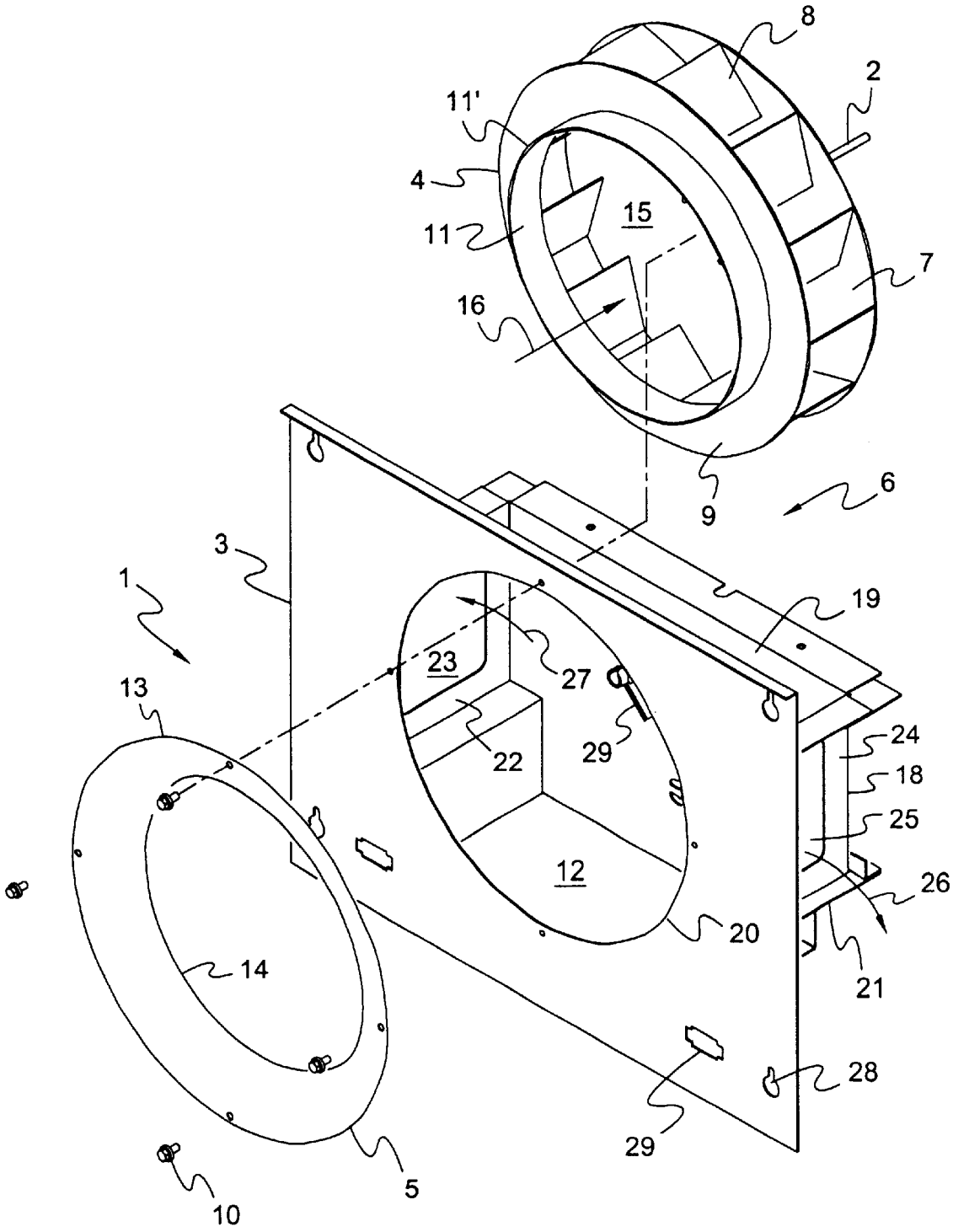
FIG. 1 (PRIOR ART)
FIG. 1 is an exploded view of the prior art blower assembly referred to hereinabove.

FIG. 1 shows an environmental control system prior art blower assembly 1 composed of a blower, e. g., centrifugal fan 4, a pre-assembled blower housing 6, and a separate, i.e. not integral, inlet ring 5.

Blower 4 is comprised of a first blade support member 7 with a blower wire harness 2, and a second spaced apart blade support member 9. Members 7 and 9 carry between them a plurality of air moving blades 8. Second blade support member 9 carries an upstanding air inlet baffle 11 through which air is pulled as shown by arrow 16 into the interior 15 of blower 4. Baffle 11 has a diameter approximately the same as the downstream, inner diameter of air inlet ring 5 and it is the outer edge 11' of this baffle that, in cooperation with the downstream inlet edge 14 of inlet ring 5, defines the aforesaid gap that is to be controlled at about 0.060 inch between the inlet ring and the blower itself.

Inlet ring 5 has an outer upstream diameter defined by edge 13 and an inner, downstream diameter defined by edge 14. The inner diameter of edge 14 is less than the outer diameter of edge 13.

Blower housing 6 which is composed of several different disparate parts that have already been assembled as shown in FIG. 1, is composed of an inlet ring support member 3, a separate blower support member 18, an open top 19, a separate lower closure member 21, and separate, apertured side members 22 and 24 having apertures 23 and 25, respectively, therein.

Blower 4 is mounted in the interior space 12 defined by the aforesaid members of lower housing 6. Inlet ring 5 is removably fixed to the separate inlet ring support member 3 by way of threaded fasteners 10. Ring 5 mates with ring support aperture 20 which is of a diameter between the inlet ring outer diameter defined by edge 13 and inner diameter defined by edge 14.

In operation, with blower 4 rotating, air is pulled into blower 4 interior volume 15 as shown by arrow 16, the interior volume being defined by first and second blade support members 7 and 9 and the air moving blades 8. Air is then forced by the blower through the apertured sides 22 and 24 as shown by arrows 27 and 26, respectively.

Note that prior art blower housing 6 has discrete apertured side members 22 and 24.

The blower housing 6 also carries various apertures such as access apertures 29 for wiring and other physical access requirements, and also key hole mounting apertures 28 for mounting blower assembly 1 in a machine.

Figure 2:
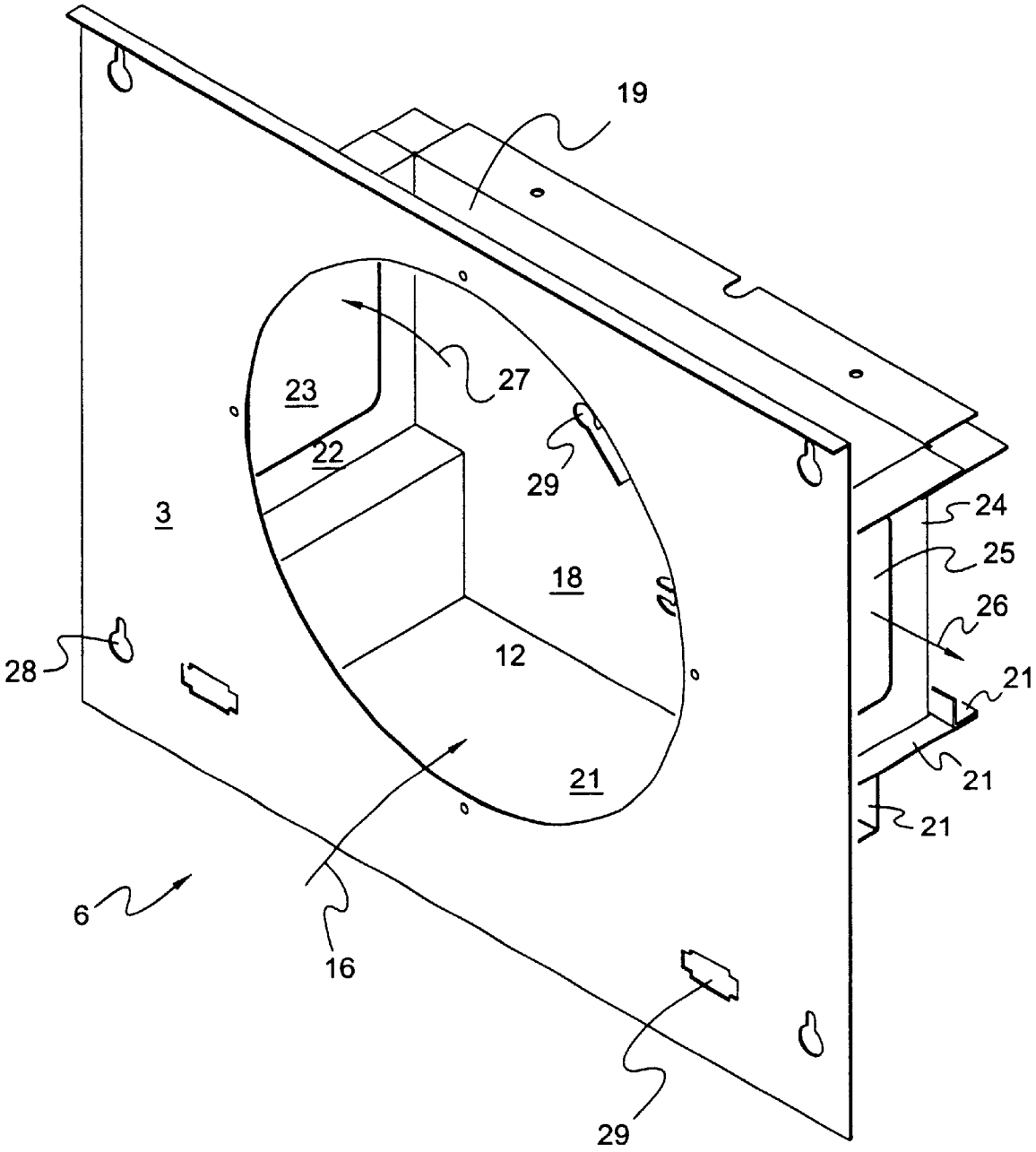
FIG. 2 (PRIOR ART)
FIG. 2 is the blower housing of the prior art blower assembly of FIG. 1 with the blower itself removed from the housing.

FIG. 2 shows the prior art blower housing 6 with blower 4 and inlet ring 5 of FIG. 1 both removed therefrom. Inlet ring 5 mounts on the upstream side of inlet ring support member 3 in aperture 20 whereas the rest of the housing parts (composed of top 19, bottom 21, back member 18 and side members 22 and 24) are fixed to the downstream side of inlet ring support member 3. This Figure more clearly shows inlet air traveling in the direction of arrow 16 and passing into the interior 12 of housing 6 before being forced by blower 4 out through apertures 25 and 23 as shown by arrows 26 and 27, respectively. This Figure also more clearly shows discrete side members 24 and 22 having apertures 25 and 23 therein, as well as open top 19.

Figure 3:
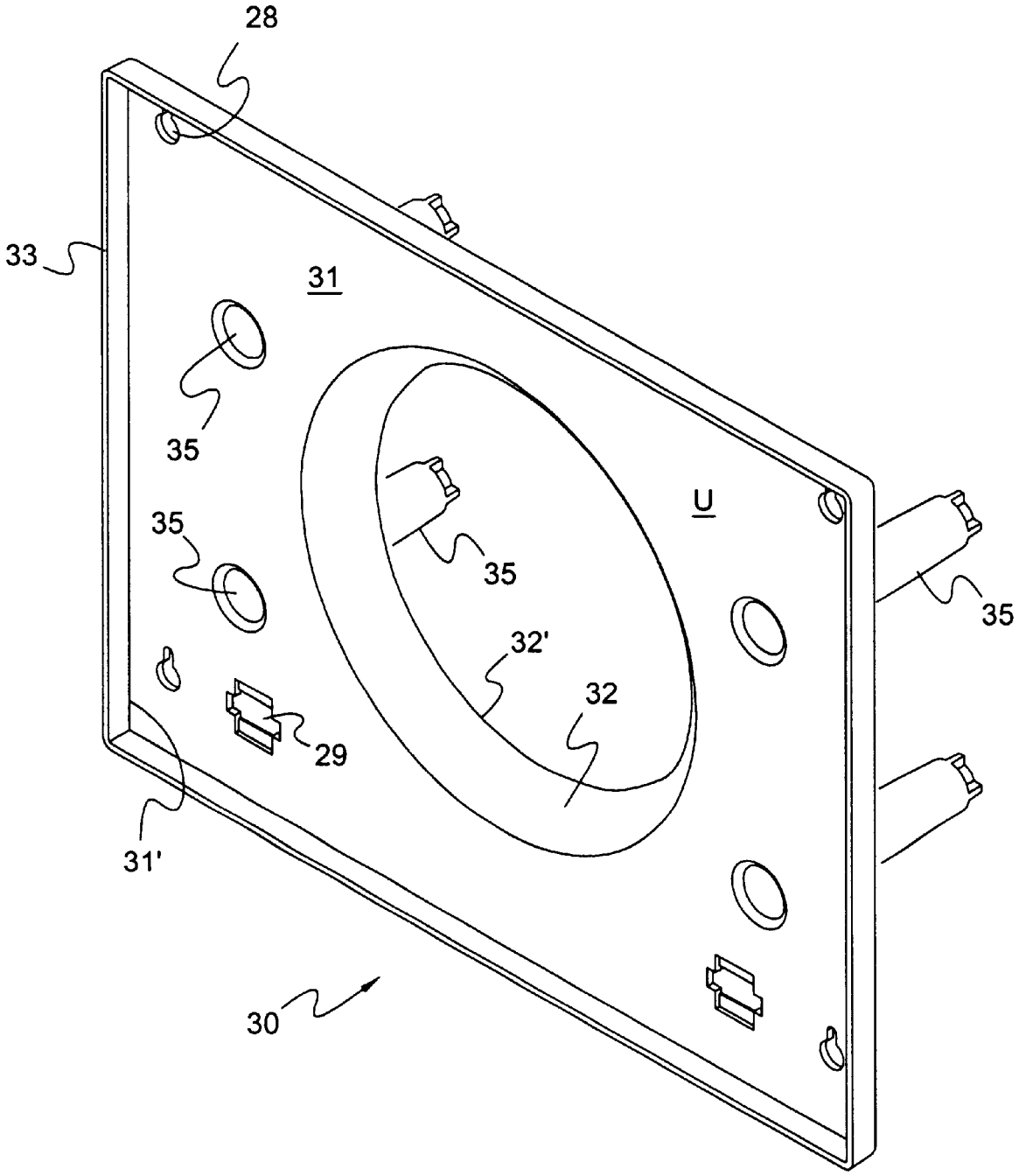
FIG. 3 is an upstream view of the integral inlet ring and inlet ring support unit of this invention.

FIG. 3 shows one embodiment of a unitary inlet ring and ring support 30 that is within this invention. FIG. 3 shows the upstream side U of the inlet ring support surface 31. Inlet ring support surface 31 has an outer periphery 31' that defines the limits of unit 30. Integral with support surface 31 is inlet ring 32 with its free standing downstream edge 32'. The outer periphery of inlet ring support surface 31 carries an upstanding edge member 33 directed upstream from surface 31. Integral with surface 31 are a plurality of upstanding columns 35 which extend from the downstream side (not shown) of surface 31. Columns 35 are directed downstream from surface 31. Surface 31 also carries various access and mounting apertures 28 and 29.

Figure 4:
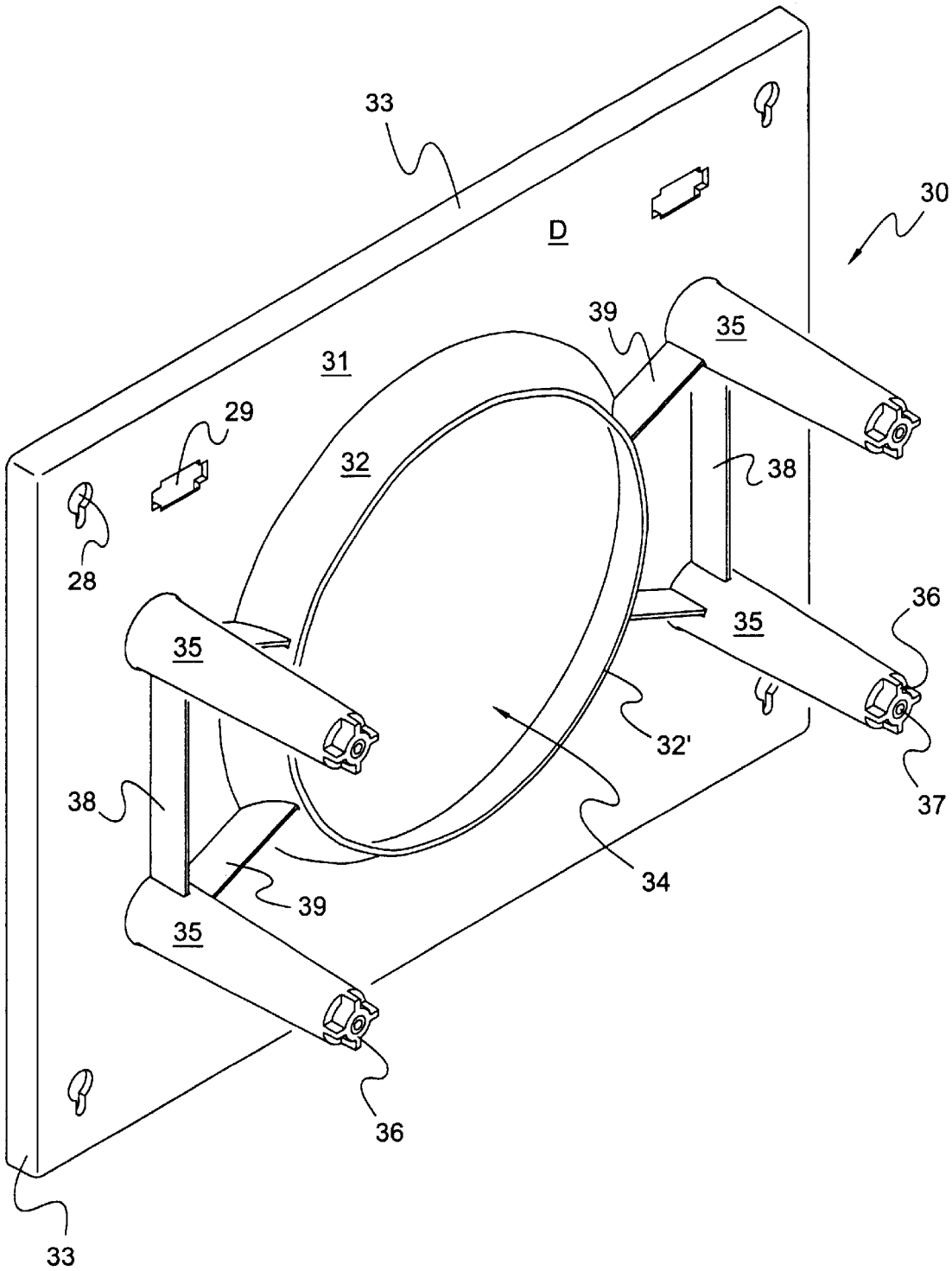
FIG. 4 is a view of the downstream side of the unitary inlet ring and inlet ring support of FIG. 3.

FIG. 4 shows the downstream side D of surface 31 of unit 30 of FIG. 3, and the downstream side of inlet ring 32 as defined by terminating downstream edge 32'.

FIG. 4 shows four upstanding columns 35 integral with surface 31, each column directed in a downstream direction and ending with a free end 36 which has a fastener or other receptacle for fastening means thereon as shown at 37. Upstanding edge member 33 is shown to be extending towards the inlet direction of surface 31 whereas inlet ring 32 is shown to be extending towards the downstream direction of surface 31.

Spaced apart columns 35 with their opposing free ends 36 define a three-dimensional volume or zone within which a blower such as blower 4 can operate. This zone is shown as 34 in FIG. 4.

FIG. 4 shows that adjacent column pairs of columns 35 can have therebetween an upstanding web 38 which can provide a strengthening and/or other function for the overall unit 30. Upstanding webs 38 can, but need not be, between all adjacent column 35 pairs, but can be between only selected column pairs as shown in FIG. 4. However, if desired, an upstanding web 38 can be provided between all columns. Separate upstanding webs 39 can be provided between a column and a close, adjacent portion of inlet ring 32. Upstanding webs 39 can be provided for every column 35 or alternating columns or any other combination as desired.

Figure 5:
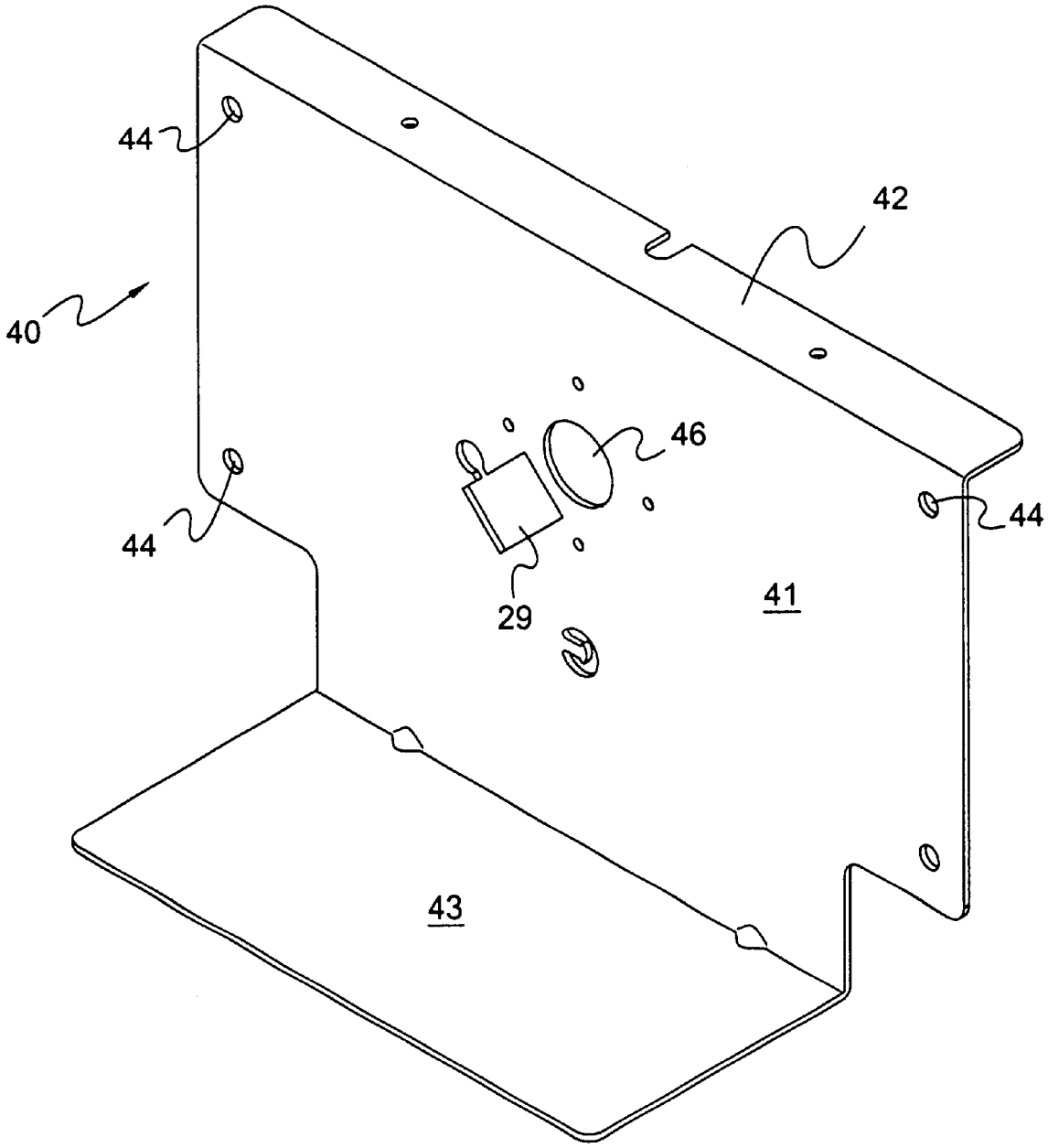
FIG. 5 is a view of the blower support member and lower closure member of the blower assembly of this invention; and, FIG. 6 shows the unitary inlet ring and support member of FIGS. 3 and 4 fixed to the blower support member of FIG. 5 with the blower of FIG. 1 mounted in the zone defined by the columns carried on the downstream side of the inlet ring support of FIG. 4.

FIG. 5 shows blower support member 40 having a blower support surface 41, and upper mounting member 42. Member 42 extends towards the downstream of surface 41. Surface 41 carries at an angle thereto (about 90° in FIG. 5) a lower closure member 43. Blower support member 41 has an aperture 46 for access for parts of the blower itself and apertures 44 for admitting fasteners that are to be attached to free ends 36 of columns 35. Member 43 extends towards the upstream side of member 41, and, therefore, under the blower, e.g., blower 4.

Figure 6:
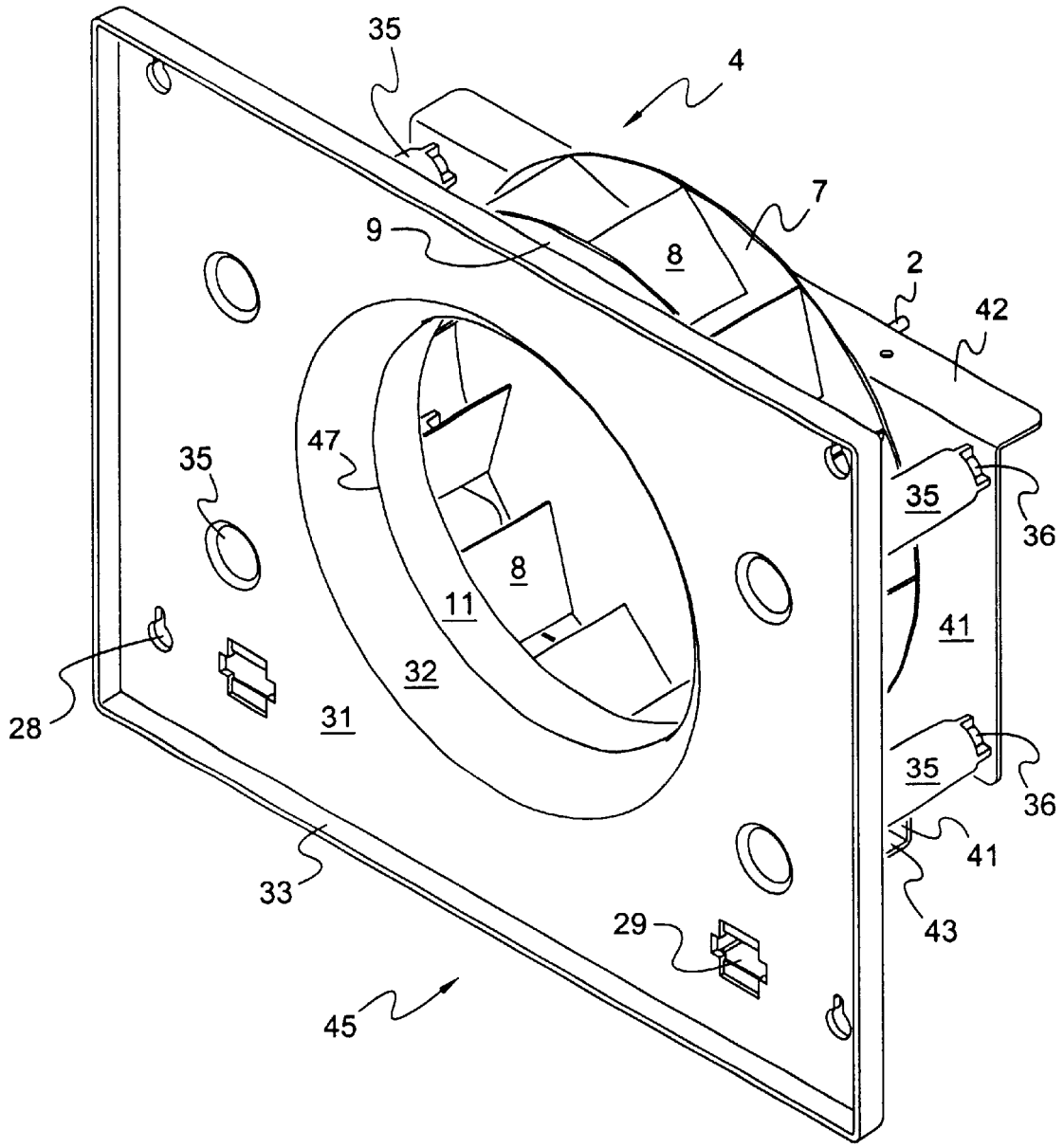

FIG. 6 shows the blower assembly 45 of this invention to be composed of the two parts of FIGS. 4 and 5 and blower 4 after blower support member 41 is fixed to free ends 36 of columns 35 and blower 4 mounted in the internal zone 34 (FIG. 4) described by columns 35 and their free ends 36. The outer edge 11' (FIG. 1) of blower baffle II when mounted as shown in FIG. 6, closely approaches downstream inlet ring edge 32' (FIG. 4) to define gap 47 between edge 11' (FIG. 1) and downstream edge 32' (FIG. 4) of inlet ring 32. This is the gap that should be maintained at about 0.060 inch, plus/minus 0.020 inch and maintained at that gap measurement throughout the operational life of the blower assembly. Note that blower assembly 45 of this invention has no discrete side means as shown by elements 22 and 24 in FIG. 1 for the prior art.

The integral inlet ring and support unit 30 of FIG. 3 can be formed of a strong plastic material such as glass-filled polycarbonate for high strength and rigidity and high vibration resistance. The other members of blower assembly 45 can be made of the same or different materials. It can readily be seen that the two-piece blower housing of FIG. 6 composed of 30 of FIG. 4 and 40 of FIG. 5 is much simpler to assemble than the multiple piece blower housing 6 of FIG. 2. For example in one such prior art blower housing multiple individual spot welds are required for attaching the blower support member 18 to housing 6, as well as attaching to one another the other separate members of the prior art blower housing 6.

The blower assembly embodiment 45 of this invention as shown in FIG. 6 provides for better control of gap 47 between inlet ring 32 and baffle 11 of blower 4. The fewer number of pieces and integral construction of those pieces that are used provides an assembly that is less subject to deformation which minimizes the likelihood of inlet ring 32 physically impinging on baffle 11 of blower 4 even with a very small gap 47. Further, the construction of blower assembly 45 provides a strength and rigidity that is substantially less subject to warping and at the same time provides better alignment between the center lines of inlet ring 32 and blower 4. Blower assembly 45 of this invention, also affords an easier, faster and more precise assembling process together with a quicker, easier installation process.

Having thus described the invention by reference to certain of its preferred embodiments, it is pointed out that the embodiments described herein are illustrative only and not limiting in nature, and that many variations and modifications are possible within the scope of this invention.

Having thus described the invention, we claim:

1. A blower housing for carrying a blower therein comprising:

a) a one-piece integral inlet ring and inlet ring support surface, said surface having integral therewith a plurality of upstanding spaced apart columns, said columns being spaced around where said blower is carried and having opposing free ends that extend beyond where said blower is carried, having at least one upstanding web extending between at least two adjacent columns so said blower can operate within the zone described by said columns and their free ends;

b) a blower support member carried by said free ends of said columns; and, c) a lower closure member carried by said blower support member, said blower housing being characterized by the absence of apertured side members.

2. The assembly of claim 1 wherein there is at least one upstanding web extending between at least one column and said inlet ring.

3. The assembly of claim 1 wherein there is at least one upstanding web extending between a plurality of adjacent column pairs and at least one upstanding web extending between each column and said inlet ring.

4. The assembly of claim 3 wherein there are at least four of said columns and said inlet ring support surface has an upstanding edge member around the periphery of said inlet ring support surface.

5. In an environmental control system of a copier/duplicator machine, said system having a blower assembly comprising a blower housing and a blower operably carried within said blower housing, the improvement comprising said blower housing having a one-piece integral inlet ring and inlet ring support member, said inlet ring support member having integral therewith a plurality of upstanding spaced apart columns that extend toward said blower, having at least one upstanding web extending between at least two adjacent columns, said columns being spaced around said blower and having opposing free ends that extend beyond said blower so said blower can operate within the zone described by said columns and their free ends.

6. The apparatus of claim 5 wherein there is at least one upstanding web extending between at least one column and said inlet ring.

7. The apparatus of claim 5 wherein there is at least one upstanding web extending between a plurality of adjacent column pairs and at least one upstanding web extending between each column and said inlet ring.

8. The apparatus of claim 7 wherein there are at least four of said columns and said inlet ring support member has an upstanding edge member around the periphery of said inlet ring support member.

9. A unitary inlet ring support having an outer periphery and an upstream side and a downstream side and having integral therewith:

a) an inlet ring;

b) a plurality of upstanding columns on the downstream side of said inlet ring support, said columns being spaced from one another around said inlet ring to define a zone within which a blower may operate, having at least one upstanding web on said downstream side of said inlet ring support, said web extending between at least two adjacent columns.

10. The unit of claim 9 wherein there is at least one upstanding web on said downstream side of said inlet ring support, said web extending between at least one column and said inlet ring.

11. The unit of claim 9 wherein there is at least one upstanding web extending between a plurality of adjacent column pairs but not all column pairs and at least one upstanding web extending between each column and said inlet ring.

12. The unit of claim 11 wherein there are at least four of said columns and said inlet ring support has an upstanding edge member around said outer periphery of said inlet ring support.

13. The unit of claim 12 wherein said upstanding edge member is carried on said upstream side of said inlet ring support.

* * * * *